US011077871B2

(12) United States Patent
Lavertu et al.

(10) Patent No.: US 11,077,871 B2
(45) **Date of Patent: *Aug. 3, 2021**

(54) VEHICLE CONTROL SYSTEM

(71) Applicant: GE Global Sourcing LLC, Norwalk, CT (US)

(72) Inventors: Thomas Michael Lavertu, Clifton Park, NY (US); Roy James Primus, Niskayuna, NY (US); Jennifer Lynn Jackson, Cohoes, NY (US)

(73) Assignee: TRANSPORATION IP HOLDINGS, LLC, Norwalk, CT (US)

( * ) Notice: Subject to any disclaimer, the term of this patent is extended or adjusted under 35 U.S.C. 154(b) by 326 days.

This patent is subject to a terminal disclaimer.

(21) Appl. No.: 16/212,238

(22) Filed: Dec. 6, 2018

(65) Prior Publication Data

US 2019/0106132 A1 Apr. 11, 2019

Related U.S. Application Data

(63) Continuation of application No. 15/397,209, filed on Jan. 3, 2017, now Pat. No. 10,183,683.

(51) Int. Cl.
*B61L 3/00* (2006.01)
*B61L 15/00* (2006.01)

(52) U.S. Cl.
CPC ..... *B61L 3/006* (2013.01); *B61L 15/0018* (2013.01); *B61L 15/0081* (2013.01); *B61L 2205/04* (2013.01)

(58) Field of Classification Search
CPC ..... B61L 15/0018; B61L 15/0081; B61L 2205/04
See application file for complete search history.

(56) References Cited

U.S. PATENT DOCUMENTS 5,561,602 A * 10/1996 Bessler ..... B60L 3/00 701/1
9,233,680 B2 * 1/2016 Daum ..... B60W 10/06
2005/0109882 A1 * 5/2005 Armbruster ..... B61L 15/0081 246/167 R (Continued)

*Primary Examiner* — Dale Moyer
(74) *Attorney, Agent, or Firm* — Christopher R. Carroll; The Small Patent Law Group LLC

(57) ABSTRACT

A control system includes a communication device onboard a vehicle system approaching or entering an airflow restricted area along a route and one or more processors. The communication device configured to receive status messages that contain data parameters representative of ambient conditions within the airflow restricted area. The processors are configured to monitor the ambient conditions and determine different power output upper limits that a trail propulsion vehicle of the vehicle system can generate within the airflow restricted area based on the ambient conditions and different power outputs generated by a lead propulsion vehicle of the vehicle system. The processors further configured to communicate instructions to control the lead propulsion vehicle within the airflow restricted area to generate the power output of the different power outputs that results in the greatest total available power output of the vehicle system as the vehicle system travels within the airflow restricted area.

20 Claims, 6 Drawing Sheets

(56) References Cited

U.S. PATENT DOCUMENTS

| | | | | |
|---|---|---|---|---|
| 2008/0125924 | A1* | 5/2008 | Daum | B61L 3/006 701/19 |
| 2013/0001370 | A1* | 1/2013 | Uzkan | B61C 17/12 246/186 |
| 2014/0180511 | A1* | 6/2014 | Daum | B60W 10/08 701/22 |
| 2017/0129513 | A1* | 5/2017 | Seaton | B61L 27/04 |

* cited by examiner

VEHICLE CONTROL SYSTEM

CROSS-REFERENCE TO RELATED APPLICATIONS

This application is a continuation of U.S. patent application Ser. No. 15/397,209, which was filed on 3 Jan. 2017 (now U.S. Pat. No. 10,183,683), and the entire disclosure of which is incorporated herein by reference.

TECHNICAL FIELD

Embodiments of the subject matter described herein relate to controlling operations of a vehicle system.

BACKGROUND

Some known vehicle systems include multiple vehicles that travel together along a route. For example, rail vehicle consists may include two or more locomotives and one or more railcars connected together. The vehicle systems may have engines that consume fuel and air (e.g., oxygen) to generate propulsive force and travel in open areas having sufficient oxygen supply and ventilation to allow engines of the vehicle systems to provide full power output (e.g., for the horsepower ratings of the engines).

However, these vehicle systems also may travel through areas where there is insufficient available oxygen supply and/or ventilation. For example, during travel in a tunnel, there may be insufficient oxygen available for combustion by the engines of the vehicle systems. If one or more vehicles having the engines are traveling behind one or more other vehicles generating exhaust, the engines in the trailing vehicles may intake the exhaust into the engines instead of oxygen. The lack of ventilation also results in an increased ambient temperature within the area, and the increased ambient temperature limits the amount of heat that can be rejected from a vehicle system traveling through the area. Because of the decreased oxygen, the intake of exhaust, and/or the reduced heat dissipation, the engines may overheat and/or produce less power. For example, the operating temperatures of the engines may increase such that the vehicles automatically decrease the output of the engines.

Some other known vehicle systems are electric vehicles powered by electric current. These systems may be powered by an onboard energy storage source (e.g., batteries) and/or off-board sources of current (e.g., catenaries and/or powered rails). However, the electric circuits can require airflow to cool components of the circuits (e.g., inverters, transformers, and the like). Without sufficient airflow, components of the circuits can overheat over time. For example, during travel in a tunnel, there may be insufficient airflow to adequately cool transformers, inverters, and the like of the circuits onboard the vehicles. As a result of the restricted airflow, the power output of the vehicles and/or time during which the vehicles may operate can be limited.

The decrease in power generated by the engines can cause the vehicle system to slow down and/or stop in the tunnel. Additionally, the length of tunnels may be limiting due to the inability of the engines and/or circuits to operate for extended periods of time within the tunnels. A need exists for methods and systems for controlling vehicle systems in tunnels or other areas where airflow is limited so that the vehicle systems travel through the tunnels faster and/or without stalling.

BRIEF DESCRIPTION

In one embodiment, a control system (e.g., for controlling a vehicle system within an airflow restricted area) is provided that includes a communication device and one or more processors operatively connected to the communication device. The communication device is onboard a vehicle system traveling along a route. The vehicle system includes a lead propulsion vehicle and a trail propulsion vehicle with the lead propulsion vehicle located ahead of the trail propulsion vehicle along a direction of travel of the vehicle system. The communication device is configured to receive status messages that contain data parameters representative of ambient conditions within an airflow restricted area along the route that the vehicle system is at least one of approaching or entering. The one or more processors are configured to monitor the ambient conditions within the airflow restricted area based on the status messages that are received. The one or more processors are further configured to determine a power output upper limit that the trail propulsion vehicle can generate within the airflow restricted area based on the ambient conditions and a first power output generated by the lead propulsion vehicle and to determine the power output upper limit of the trail propulsion vehicle within the airflow restricted area based on the ambient conditions and a second power output generated by the lead propulsion vehicle. The second power output is smaller than the first power output. Responsive to a total available power output of the vehicle system within the airflow restricted area with the lead propulsion vehicle generating the second power output exceeding the total available power output of the vehicle system with the lead propulsion vehicle generating the first power output, the one or more processors are configured to communicate instructions to control the lead propulsion vehicle to generate the second power output within the airflow restricted area.

In another embodiment, a method (e.g., for controlling a vehicle system within an airflow restricted area) is provided that includes monitoring ambient conditions within an airflow restricted area along a route traveled by a vehicle system as the vehicle system at least one of approaches or enters the airflow restricted area. The vehicle system includes a lead propulsion vehicle and a trail propulsion vehicle with the lead propulsion vehicle located ahead of the trail propulsion vehicle along a direction of travel of the vehicle system. The method also includes determining a power output upper limit that the trail propulsion vehicle can generate within the airflow restricted area based on the ambient conditions and a first power output generated by the lead propulsion vehicle. The method further includes determining the power output upper limit of the trail propulsion vehicle within the airflow restricted area based on the ambient conditions and a second power output generated by the lead propulsion vehicle. The second power output is smaller than the first power output. In response to a total available power output of the vehicle system within the airflow restricted area with the lead propulsion vehicle generating the second power output exceeding the total available power output of the vehicle system with the lead propulsion vehicle generating the first power output, the method includes communicating instructions to control the lead propulsion vehicle to generate the second power output within the airflow restricted area.

In another embodiment, a control system (e.g., for controlling a vehicle system within an airflow restricted area) is provided that includes one or more sensors disposed on a vehicle system traveling on a route that includes an airflow restricted area. The vehicle system includes a trail propulsion vehicle and a lead propulsion vehicle that is located ahead of the trail propulsion vehicle along a direction of travel of the vehicle system. The one or more sensors are configured to monitor ambient conditions within the airflow restricted area as the vehicle system enters the airflow restricted area. The one or more processors communicatively connected to the one or more sensors and configured to receive data parameters representative of the ambient conditions within the airflow restricted area from the one or more sensors. The one or more processors are configured to determine a power output upper limit that the trail propulsion vehicle can generate within the airflow restricted area based on the ambient conditions and a first power output generated by the lead propulsion vehicle and to determine the power output upper limit of the trail propulsion vehicle based on the ambient conditions and a second power output generated by the lead propulsion vehicle. The second power output is smaller than the first power output. The one or more processors are configured to communicate instructions to control the lead propulsion vehicle to generate the second power output within the airflow restricted area responsive to determining that a total available power output of the vehicle system within the airflow restricted area with the lead propulsion vehicle generating the second power output exceeds the total available power output of the vehicle system with the lead propulsion vehicle generating the first power output.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
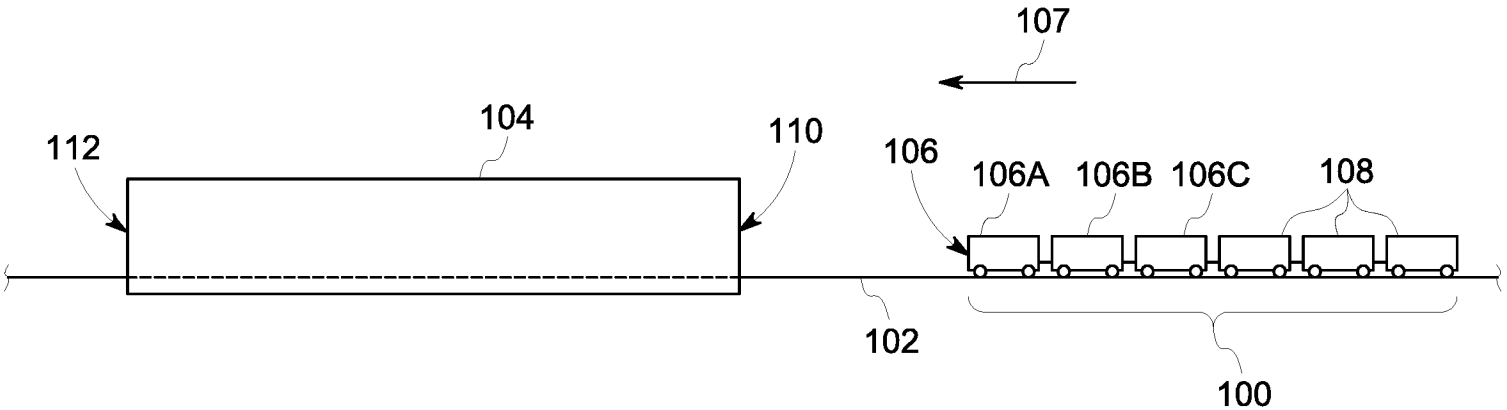
FIG. 1 illustrates a schematic diagram of one example of a vehicle system traveling along a route toward an airflow restricted area.

FIG. 1 illustrates a schematic diagram of one example of a vehicle system 100 traveling along a route 102 toward an airflow restricted area 104. The vehicle system 100 includes several vehicles 106, 108 that travel together along the route 102. The vehicles 106, 108 are connected with each other, such as by couplers, to form a string of vehicles. In an alternative embodiment, the vehicles 106, 108 are not mechanically connected to each other, but rather are operationally connected via a communication network to controls the vehicles 106, 108 to travel together along the route 102 with a designated spacing between adjacent vehicles 106, 108.

The vehicles 106 (e.g., vehicles 106A-C) represent propulsion vehicles that can generate propulsive force to propel the vehicle system 100 along the route 102. The vehicles 106 in the illustrated embodiment include a lead propulsion vehicle 106A, a trail propulsion vehicle 106C, and an intermediate propulsion vehicle 106B disposed between the lead and trail vehicles 106A, 106C along a length of the vehicle system 100. The lead propulsion vehicle 106A and the intermediate propulsion vehicle 106B are leading vehicles disposed ahead of the trail vehicle 106C in a direction of travel 107 of the vehicle system 100 along the route 102 towards the airflow restricted area 104. The intermediate propulsion vehicle 106B and the trail propulsion vehicle 106C are trailing vehicles disposed rearward of the lead vehicle 106A in the direction of travel 107. Although the propulsion vehicles 106A-C are shown as being directly coupled with each other, two or more of the propulsion vehicles 106A-C may be separated from one another by one or more of the vehicles 108. Examples of propulsion vehicles 106 include locomotives, other off-highway vehicles (e.g., vehicles that are not designed for or permitted to travel on public roadways), automobiles (e.g., vehicles that are designed for traveling on public roadways), marine vessels, and the like. The vehicles 108 represent non-propulsion vehicles incapable of generating propulsive force to propel the vehicle system 100 along the route 102. The non-propulsion vehicles 108 may be rail cars, trailers, or other vehicle units that are propelled along the route 102 by the propulsion vehicles 106. The group of propulsion vehicles 106 may represent a vehicle consist. While three propulsion vehicles 106 and three non-propulsion vehicles 108 are shown in the illustrated embodiment, alternatively, the vehicle system 100 may have a smaller or greater number of the propulsion vehicles 106 and/or the non-propulsion vehicles 108.

One or more of the propulsion vehicles 106 can include propulsion systems having engines that consume fuel and oxygen (e.g., from the air) to generate electric current to power one or more traction motors to generate propulsive force and/or engines that consume fuel and oxygen to rotate a shaft to generate propulsive force. The propulsive force is used to rotate axles and wheels of the vehicle system 100 to move the vehicle system 100 along the route 102. Additionally or alternatively, one or more of the propulsion vehicles 106 can be electric powered vehicles that power one or more traction motors with an onboard source of electric energy (e.g., a battery) and/or an off-board source of electric energy (e.g., a catenary or powered rail) to generate propulsive force (instead of generating current from an engine-generator or engine-alternator set). Additionally or alternatively, one or more of the propulsion vehicles 106 can include hybrid propulsion systems that include motors powered by both fuel-consuming engines and electric energy.

The airflow restricted area 104 represents a volume of space through which the route 102 extends and through which the vehicle system 100 travels when traversing the route 102. The volume represented by the airflow restricted area 104 has a reduced supply of oxygen (e.g., a reduced oxygen content or concentration in the air) and/or a reduced flow rate of air relative to locations that are outside of the area 104, such as in the vicinity of the area 104. By way of example, the airflow restricted area 104 may represent a tunnel and/or a ravine through which the route 102 passes. For example, if the propulsion vehicles 106 include engines that consume oxygen to propel the vehicles 106, then the airflow restricted area 104 may include less oxygen or a reduced flow of oxygen that is capable of being combusted by the engines of the vehicles 106 when the vehicle system 100 travels through the area 104 relative to one or more locations that are outside of the airflow restricted area 104. Furthermore, due to the reduced flow rate of air, the heat generated by the engines of the vehicles 106 while traveling through the airflow restricted area 104 may not be dissipated away from the vehicle system 100. As a result, the heat rejected from the leading vehicles 106 raises the ambient temperatures experienced by the trailing vehicles 106. The increased temperatures experienced by the trailing vehicles 106 reduces the amount of heat that can be rejected by the trailing vehicles 106 into the ambient environment (relative to the vehicle system 100 traveling outside of the area 104 in a region with greater airflow).

As another example, if one or more of the propulsion vehicles 106 include electric circuits that use electric current from an onboard energy store (e.g., a battery) or an off-board source, these circuits can include components that become heated during operation (e.g., inverters, transformers, motors, and the like). These components may have limited heat rejection capabilities and, as a result, can become overheated during travel in the airflow restricted area 104. For example, operation of these components over extended time periods in the reduced airflow environment of the area 104 can result in the components overheating and being unable to continue operating (e.g., to propel the vehicles 106).

The vehicle system 100 can coordinate the operations of the propulsion vehicles 106 as the vehicle system 100 approaches and travels through the airflow restricted area 104. The operations of the vehicles 106 can be coordinated with respect to one another to allow the vehicle system 100 to achieve a goal related to traveling through and exiting the airflow restricted area 104. For example, in one embodiment the goal may be to travel through and exit the airflow restricted area 104 as quickly as possible while adhering to applicable safety, regulatory, and mechanical constraints, such as upper speed limits, emissions limits, and/or engine capability limits. For example, it may be desirable for the vehicle system 100 to travel as quickly as possible and permitted through the airflow restricted area 104 to reduce travel time to a destination, receive a monetary bonus or other benefit for arriving at the destination before a scheduled arrival time, or the like. Other goals may be traveling through and exiting the airflow restricted area 104 within a designated time period, prior to a designated time, with at least a designated speed, and/or with at least a designated total power output. The designated time period, designated time, designated speed, and/or designated total power output may be based on a schedule of the vehicle system 100. For example, the vehicle system 100 may need to travel through the airflow restricted area 104 within the designated time period in order to remain on schedule and not fall behind schedule.

During travel in the area 104, the reduced airflow can cause the power output provided by one or more of the propulsion vehicles 106 to decrease. For example, the trail propulsion vehicle 106C may begin to derate. With respect to the propulsion vehicles 106 that combust fuel, the power output from the vehicle 106C may decrease because of the decrease in oxygen available for combustion by the propulsion system of the vehicle 106C and/or due to the increase intake into the engine of the vehicle 106C of exhaust from the propulsion systems of the leading propulsion vehicles 106A, 106B. Because of the heat and exhaust gas emitted from the propulsion systems of the leading vehicles 106A, 106B ahead and the reduced airflow that dissipates heat, the trailing vehicle 106C cannot reject as much heat into the ambient environment (relative to traveling in an area with better ventilation). The reduced ability to reject heat causes the temperature of the propulsion system (e.g., the engine temperature, oil temperature, cooling fluid temperature, and the like) to increase, which forces the engine of the trailing vehicle 106C to derate. With respect to the propulsion-generating vehicles 106 that are electrically powered (e.g., via an onboard energy store of electric energy and/or an off-board source of electric current), the power output from the trail propulsion vehicle 106C may decrease because of the decrease in airflow available for cooling electric components of the vehicle 106, such as transformers, inverters, motors, and the like. The increase in temperature can cause the propulsion system of the trailing vehicle 106C to derate.

When a vehicle derates, the power output that the vehicle can automatically generate decreases due to internal limits, such as a limited amount of available oxygen for combustion and/or high engine oil temperature. If an operator controls a vehicle to generate a power output associated with level 10, the actual power output generated by the vehicle may drop to level 5, for example, as the vehicle derates. Therefore, a derated propulsion vehicle results in a reduced power output capability of the vehicle.

In some known methods of controlling a vehicle system along a route, the propulsion vehicles of the vehicle system are each controlled to produce a power output upper limit of the propulsion vehicle as the vehicle system enters and travels through an airflow restricted area. The intent is for the vehicle system to operate at a maximum power setting or level to travel through the airflow restricted area in the shortest amount of time as possible and/or permitted. However, due to the ambient conditions within the airflow restricted area, the propulsion vehicles may derate within the airflow restricted area, which significantly reduces the actual power output provided by the propulsion vehicles. Thus, a total actual power output provided by the vehicle system through the airflow restricted area may be only a fraction of the desired power output upper limit that was requested by the operator. For example, the lead propulsion vehicle 106A operating at power output upper limit, such as at a tractive setting designated 10, generates more power relative to operating at a reduced power output, such as at a tractive setting designated 6, but also generates significantly more heat and exhaust gas at setting 10 relative to setting 6. The increased heat and exhaust gas discharged into the airflow restricted area responsive to the lead vehicle operating at tractive setting 10 causes the trailing propulsion vehicles to derate earlier and/or at a higher rate relative to the lead vehicle operating at tractive setting 6. When the lead vehicle operates at the reduced tractive setting, the trailing propulsion vehicles can generate a greater power output compared to the lead vehicle operating at the higher tractive setting. As a result, for vehicle systems that include multiple propulsion vehicles used to propel the vehicle system along the route, operating the lead vehicle within an airflow restricted area at an intermediate power output (e.g., at tractive setting 6 or the like) may allow for an overall increase in a total available amount of power output of the vehicle system relative to operating the lead vehicle at the power output upper limit (e.g., at tractive setting 10).

In one or more embodiments, a control system is configured to determine how potential power outputs generated by the leading propulsion vehicles 106A, 106B of the vehicle system 100 affect the power outputs that the trailing vehicles 106B, 106C can generate within the airflow restricted area 104 based on the conditions within the airflow restricted area 104, the characteristics of the airflow restricted area 104, and/or the characteristics of the vehicle system 100. Based on this determination, the control system may select a set or scheme of designated power outputs (e.g., tractive settings) for the propulsion vehicles 106 such that a total power output provided by the vehicle system 100 according to the selected scheme of power outputs is greater than the total power outputs according to the other, non-selected schemes. Controlling the propulsion vehicles 106 according to the selected scheme results in the vehicle system 100 traveling through the airflow restricted area 104 faster and in less time than controlling the propulsion vehicles 106 according to one of the non-selected schemes.

Figure 2:
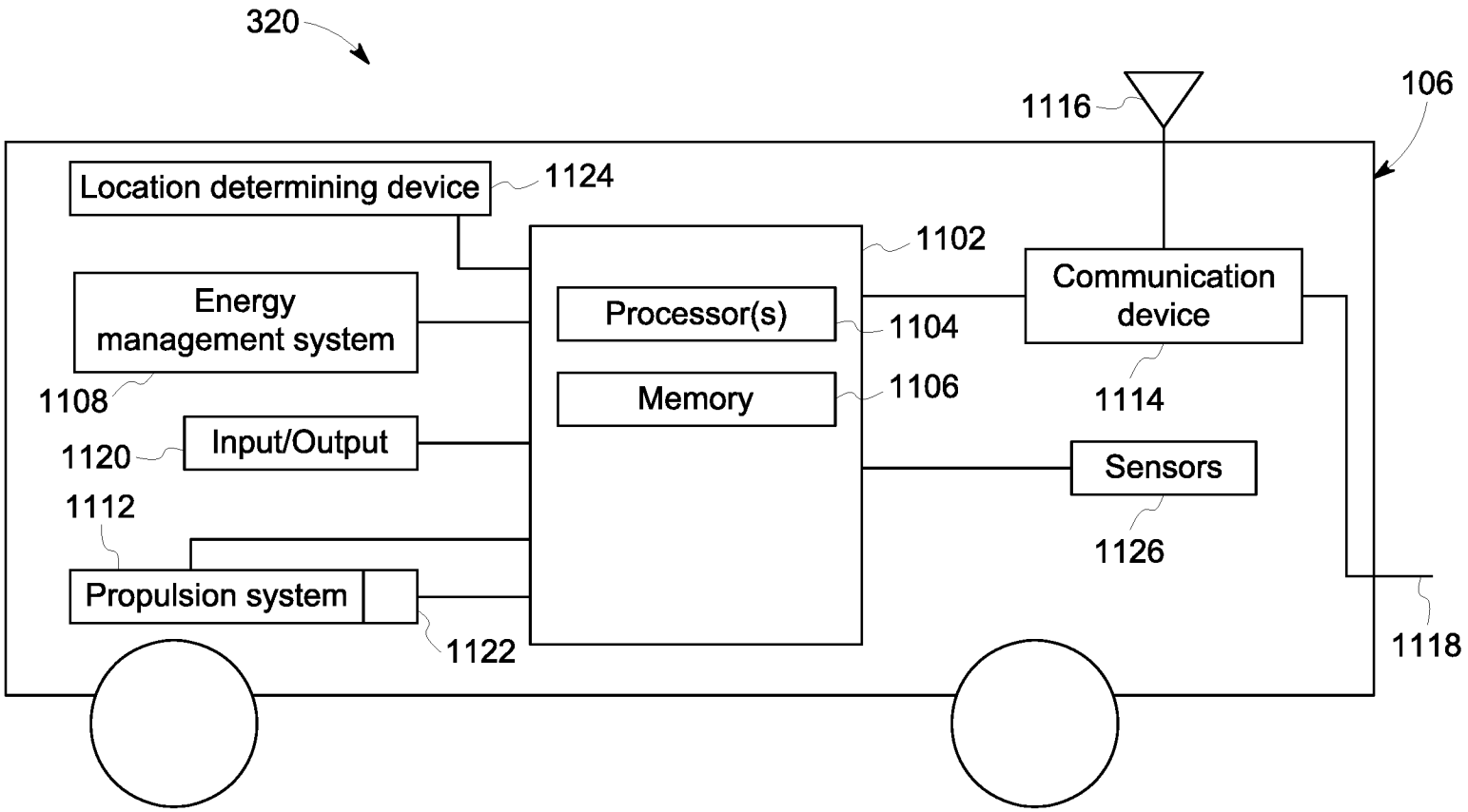
FIG. 2 is a schematic diagram of one embodiment of a vehicle control system disposed on one of the propulsion vehicles of the vehicle system shown in FIG. 1.

FIG. 2 is a schematic diagram of one embodiment of a vehicle control system 320 disposed on one of the propulsion vehicles 106 of the vehicle system 100 shown in FIG. 1. The vehicle control system 320 is configured to control operations of the vehicle system 100 along the route 102 as the vehicle system 100 approaches and enters the airflow restricted area 104. The propulsion vehicle 106 includes a propulsion system 1112, which can represent one or more engines, motors, brakes, batteries, cooling systems (e.g., radiators, fans, etc.), and the like, that operate to generate power output to propel the vehicle 106 and to generate braking effort to slow and/or stop the vehicle 106. Additionally or alternatively, the propulsion system 1112 can include electric components that power motors to propel the vehicle 106 using electric energy obtained from an onboard storage device (e.g., batteries) and/or from an off-board source (e.g., a catenary and/or electrified rail), such as transformers, converters, inverters, and the like. One or more propulsion sensors 1122 may be operatively connected with the propulsion system 1112 in order to obtain data representative of operational parameters of the propulsion system 1112. For example, the sensors 1122 may measure data that is representative of lubricant temperature of the propulsion system 1112 (e.g., engine oil temperature), coolant temperature of the cooling system of the propulsion system 1112 (e.g., water temperature), an actual power output of the propulsion system 1112, and the like. For example, the sensors 1122 may include an electrical voltage sensor that measures an electrical power output of the propulsion system 1112. One or more input and/or output devices 1120 on the vehicle 106, such as keyboards, throttles, switches, buttons, pedals, microphones, speakers, displays, touchscreens, and the like, may be used by an operator to provide input and/or monitor output of one or more systems of the vehicle 106.

The vehicle 106 includes an onboard vehicle controller 1102 that controls operations of the vehicle 106 and/or the vehicle system 100 (shown in FIG. 1). The vehicle controller 1102 may define all or a portion of a control system that controls operations of the vehicle system 100 (shown in FIG. 1) through an airflow restricted area. Optionally, the vehicle system 100 or a consist may have only a single vehicle controller 1102 that is located on one of the propulsion vehicle 106. The other propulsion vehicles 106 in the vehicle system 100 and/or consist may be controlled based on instructions received from the propulsion vehicle 106 that has the controller 1102. Alternatively, several propulsion vehicles 1100 may include the controller 1102 and assigned priorities among the controllers 1102 may be used to determine which controller 1102 controls operations of the propulsion vehicles 106. For example, an overall vehicle system controller system may include two or more of the vehicle controllers 1102 disposed onboard different propulsion vehicles 106 that communicate with each other to coordinate operations of the vehicles 106 as described herein.

The vehicle controller 1102 may represent a hardware and/or software system that operates to perform one or more functions described herein. For example, the controller 1102 units may include one or more processor(s) 1104 or other logic-based device(s) that perform operations based on instructions stored on a tangible and non-transitory computer readable storage medium or memory 1106. The controller 1102 may additionally or alternatively include one or more hard-wired devices that perform operations based on hard-wired logic of the devices. The controller 1102 may represent the hardware that operates based on software or hardwired instructions, the software that directs hardware to perform the operations, or a combination thereof.

The propulsion vehicle 106 includes a location determining device 1124 that determines a location of the vehicle 106 as the vehicle 106 travels along the route. The location determining device 1124 may be a Global Positioning System receiver that obtains location data representative of the location of the vehicle 106. The one or more processors 1104 of the controller 1102 are communicatively coupled (e.g., via one or more wired or wireless connections) to the location determining device 1124, and are configured to analyze the data to determine the location of the vehicle 106 as the vehicle 106 moves. The one or more processors 1104 may compare the location of the vehicle 106 based on the global positioning data to a map or trip schedule to determine a level of progress of the vehicle 106 along the route and/or a proximity of the vehicle 106 to one or more locations of interest, such as an airflow restricted area. For example, based on the location data received from the location determining device 1124, the one or more processors 1104 may be able to determine that the vehicle system 100 (shown in FIG. 1) including the vehicle 106 is approaching the entrance 110 and/or exit 112 (FIG. 1) of the airflow restricted area 104, as described above.

Alternatively or additionally, the one or more processors 1104 may calculate or estimate the location of the vehicle 106 along a route based on speeds of the vehicle 106 and a time elapsed since the vehicle 106 passed a known location. In another embodiment, the one or more processors 1104 may determine the location of the vehicle 106 using another technique, such as by communicating information with wayside transponders or other devices, receiving input from an operator of the vehicle 106, or the like. Alternatively, the location determining device 1124 may be disposed onboard another propulsion vehicle 106 or a non-propulsion vehicle 108 of the vehicle system 100. The relative locations between a front vehicle in the vehicle system and the vehicle that includes the location determining device 1124 may be known such that the determined location of the vehicle having the location determining device 1124 may be converted into the location of the front vehicle in the vehicle system 100.

The controller 1102 is communicatively coupled with a communication device 1114 of the vehicle 106 via a wired or wireless connection. The communication device 1114 can communicate with an off-board location, such as another vehicle system, a dispatch facility, another vehicle in the same vehicle system, a wayside device (e.g., transponder), or the like. The communication device 1114 can communicate with the off-board location via wired and/or wireless connections (e.g., via radio frequency). The communication device 1114 can include a wireless antenna 1116 and associated circuitry and software to communicate wirelessly. For example, the communication device 1114 may include a transceiver or a separate receiver and transmitter. Additionally or alternatively, the communication device 1114 may be connected with a wired connection via a cable 1118 to another vehicle in the vehicle system 100 or consist. For example, the cable 1118 may be a trainline, a multiple unit cable, an electronically-controlled pneumatic brake line, or the like. The communication device 1114 can be used to transmit a variety of information described herein, such as control signals to other propulsion vehicles of the vehicle system identifying designated power outputs to be provided by the other propulsion vehicles as the vehicle system approaches an airflow restricted area, operating parameters (e.g., lubricant and/or water temperatures), actual power outputs provided by the propulsion system 1112, and the like. The communication unit 1114 can also be used to receive information from an offboard location such as status messages from another vehicle in the same vehicle system, another vehicle system, and/or a wayside device that provide data parameters representative of ambient conditions within an upcoming airflow restricted area along the route. The communication unit 1114 can also be used to receive actual power outputs generated by other propulsion vehicles (e.g., to identify derating), trip plans, trip schedules (e.g., designated time periods in which to pass through airflow restricted areas), location information from a different vehicle that has the location determining device 1124, location information of airflow restricted areas along the route, and the like.

The vehicle 106 in FIG. 2 further includes an energy management system 1108 communicatively coupled with the controller 1102. The energy management system 1108 can create and/or obtain a trip plan, which designates operational settings of the vehicle system 100 (e.g., throttle settings, power outputs, speed, braking efforts, and the like) as a function of at least one of location, time elapsed, or distance traveled during a trip along the route 102. A trip plan can differ from a schedule in that the schedule may direct the vehicle system 100 where to be located and at what times the vehicle system 100 is to be at the locations of the schedule. The trip plan, however, may designate the operational settings in order to control the vehicle system 100 within external constraints while achieving one or more goals, such as traveling according to a schedule, reducing fuel consumption, and/or reducing total travel time to complete a trip. The external constraints may be limits on the amount of fuel consumed, the amount of emissions generated, speed limits, noise limits, and the like. For example, the vehicle system 100 traveling along the route 102 from a starting location to a finishing location within a designated time according to a trip plan may consume less fuel or produce fewer emissions than the same vehicle system 100 traveling along the same route 102 from the same starting location to the same finishing location within the same designated time, but according to another trip plan or according to manual control of the vehicle system 100. One or more examples of trip plans (also referred to as mission plans or trip profiles) and how the trip plans are determined are provided in U.S. patent application Ser. No. 11/385,354, the entire disclosure of which is incorporated by reference.

The energy management system 1108 may represent a hardware and/or software system that operates to perform one or more functions described herein. For example, the energy management system 1108 may include one or more computer processor(s), controller(s), or other logic-based device(s) that perform operations based on instructions stored on a tangible and non-transitory computer readable storage medium. Alternatively or additionally, the energy management system 1108 may include one or more hard-wired devices that perform operations based on hard-wired logic of the devices. The energy management system 1108 may represent the hardware that operates based on software or hardwired instructions, the software that directs hardware to perform the operations, or a combination thereof.

The energy management system 1108 can create a trip plan, retrieve a trip plan from a memory of the energy management system 1108 or the memory 1106 of the controller 1102, and/or receive the trip plan from an off-board location via the communication device 1114. The controller 1102 (e.g., the one or more processors 1104) can refer to the trip plan in order to determine the designated power outputs to be generated by the propulsion vehicles of the vehicle system 100 for travel along the route 102. In an alternative embodiment, the vehicle 106 does not include an energy management system 1108 disposed onboard the vehicle 106. For example, the vehicle 106 may receive a trip plan and/or a trip schedule from an off-board location, such as a dispatch location or another vehicle of the same vehicle system, and the controller 1102 may designate operational settings of the vehicle 106 based on the received trip plan and/or trip schedule.

The vehicle 106 further includes one or more ambient condition sensors 1126 disposed onboard the vehicle 106 that are configured to measure conditions in the ambient environment surrounding the vehicle 106. The ambient condition sensors 1126 may measure air temperature, pressure, oxygen content (e.g., a concentration or amount of available oxygen in the air), air flow rate, and/or the like. The ambient condition sensors 1126 may include a thermometer or thermocouple, a pressure sensor, a mass flow sensor, an oxygen sensor, and/or the like. The ambient condition sensors 1126 are operatively coupled to the controller 1102 and are configured to provide the controller 1102 data parameters representative of the corresponding ambient conditions to allow the controller 1102 to monitor the ambient conditions surrounding the vehicle 106. The sensors 1126 may measure and provide the data parameters periodically or responsive to receiving a prompt from the controller 1102 for updated data parameters.

The components of the propulsion vehicle 106 described above may define at least a portion of the vehicle control system 320. For example, in one embodiment, the vehicle control system 320 includes the one or more processors 1104 of the vehicle controller 1102 and the ambient condition sensors 1126. For example, the one or more processors 1104 may monitor the ambient conditions within the airflow restricted area 104 as the vehicle 106 enters the area 104, and the one or more processors 1104 may determine how to distribute power output among the propulsion vehicles 106 of the vehicle system 100 based on the ambient conditions that are monitored by the onboard sensors 1126. In another embodiment, the vehicle control system 320 may include the communication device 1114 instead of, or in addition to, the ambient condition sensors 1126. For example, the communication device 1114 may receive status messages from an off-board location that include data parameters representative of the ambient conditions within the airflow restricted area 104, as described below with respect to FIG. 3. Therefore, the one or more processors 1104 may determine how to distribute power output among the propulsion vehicles 106 of the vehicle system 100 based on the ambient conditions that are monitored remotely before the vehicle system 100 enters the airflow restricted area. Optionally, the vehicle control system 320 may include additional components of the vehicle 106, such as the propulsion system 1112, the location determining device 1124, and/or the energy management system 1108.

Figure 3:
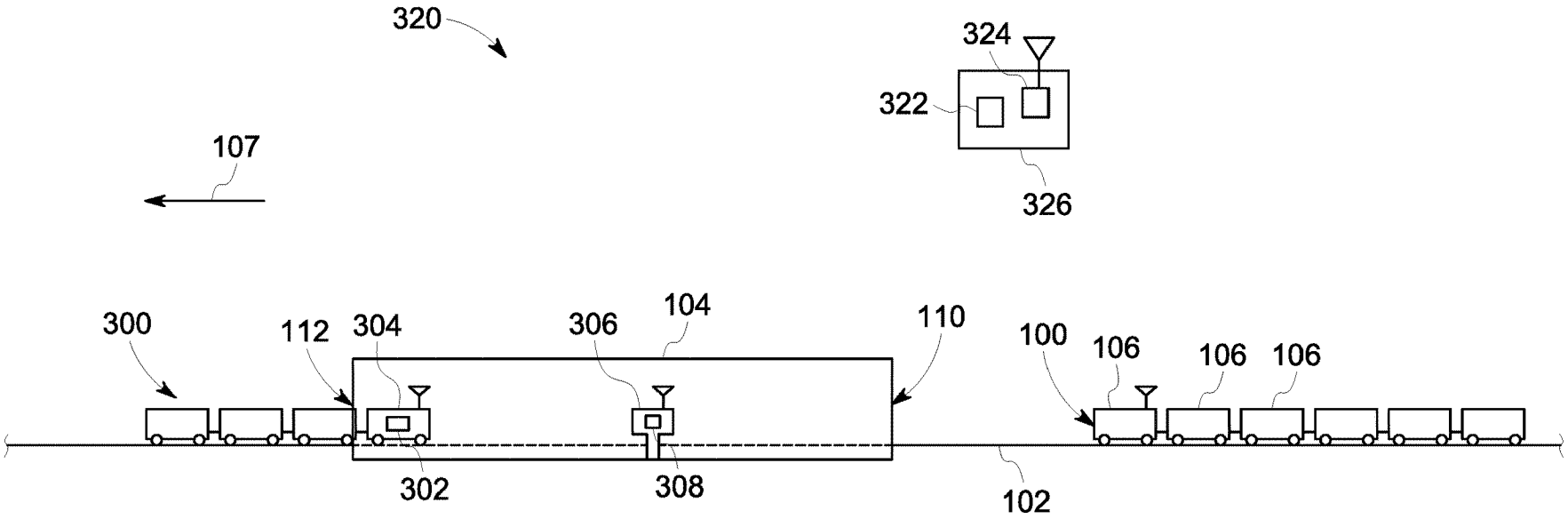
FIG. 3 illustrates a schematic diagram of the vehicle system traveling along the route toward the airflow restricted area and another vehicle system traveling along the route through an exit of the airflow restricted area according to an embodiment.

FIG. 3 illustrates a schematic diagram of the vehicle system 100 traveling along the route 102 toward the entrance 110 of the airflow restricted area 104 and another vehicle system 300 traveling along the route 102 through the exit 112 of the airflow restricted area 104 according to an embodiment. The vehicle system 300 is disposed ahead of the vehicle system 100 along the route 102 and traveling in the same direction 107 as the vehicle system 100. In the illustrated embodiment, the vehicle system 300 includes one or more ambient condition sensors 302 disposed on a vehicle 304 of the vehicle system 300. The one or more ambient condition sensors 302 may be similar to the one or more ambient condition sensors 1126 (shown in FIG. 2) of the vehicle 106 of the vehicle system 100. For example, as the vehicle system 300 travels through the airflow restricted area 104, the sensors 302 may measure ambient conditions within the airflow restricted area 104, such as temperature, pressure, oxygen content, and/or rate of airflow. Since the vehicle system 300 is currently traveling through the airflow restricted area 104, the ambient condition information is current. The vehicle system 300 may include a communication device (not shown) similar to the communication device 1114 of the vehicle 106 that is able to transmit data parameters representative of the measured ambient conditions within the airflow restricted area 104 remotely, such as to the vehicle system 100 that is approaching the airflow restricted area 104.

FIG. 3 additionally shows a wayside device 306 disposed within the airflow restricted area 104. The wayside device 306 may include one or more ambient condition sensors 308 disposed thereon or operatively coupled thereto. The ambient condition sensors 308 are configured to measure the ambient conditions within the airflow restricted area 104, such as temperature, pressure, oxygen content, and rate of airflow. The ambient condition sensors 308 are mounted within the airflow restricted area 104, such that the sensors 308 do not move through the airflow restricted area 104 unlike the sensors 302, 1126 on the vehicle systems 300, 100, respectively. Although not shown, the wayside device 306 may include a communication device similar to the communication device 1114 of the vehicle 106 that is able to transmit data parameters representative of the measured ambient conditions within the airflow restricted area 104 remotely, such as to the vehicle system 100 that is approaching the airflow restricted area 104.

In one embodiment, the vehicle control system 320 includes the one or more processors 1104 of the vehicle 106 shown in FIG. 2, the communication device 1114 on the vehicle 106 (FIG. 2), and at least one of the onboard sensors 1126 (FIG. 2), the sensors 302 on the vehicle system 300 ahead, or the sensors 308 mounted within the airflow restricted area 104 to monitor the ambient conditions within the airflow restricted area 104. In one embodiment, as the vehicle system 100 approaches the airflow restricted area 104, the vehicle system 100 receives a status message from the wayside device 306 and/or the vehicle system 300 ahead that includes data parameters representative of the ambient conditions within the airflow restricted area 104. The vehicle system 100 may communicate directly with the wayside device 306 and/or the vehicle system 300, or indirectly via a remote dispatch location. For example, the wayside device 306 and/or vehicle system 300 may transmit the status messages to the dispatch location, and the dispatch location may forward the relevant information to the vehicle system 100 when the vehicle system 100 approaches the airflow restricted area 104.

In an alternative embodiment, the one or more processors of the vehicle control system 320 may be located off-board the vehicle system 100, such as at a dispatch location 326. For example, the dispatch location 326 includes one or more processors 322 and a communication device 324. The dispatch location 326 may monitor the ambient conditions within the airflow restricted area 104 by receiving status messages from the vehicle system 300, the wayside device 306, and/or the vehicle system 100 that include data parameters representative of the ambient conditions within the area 104. After determining the distribution of power outputs among the propulsion vehicles 106 of the vehicle system 100 for when the vehicle system 100 enters the airflow restricted area 104, the dispatch location 326 may communicate a control message to the vehicle system 100, via the communication device 324, that designates operational settings used to control the movement of the vehicle system 100 through the area 104. Therefore, although in one or more embodiments the one or more processors of the vehicle control system 320 are disposed on the vehicle system 100 approaching the airflow restricted area 104, in alternative embodiments the one or more processors of the vehicle control system 320 are disposed off-board the vehicle system 100, such as at the dispatch location 326, on the vehicle system 300 ahead on the route, or even on the wayside device 306.

Due to reduced ventilation, the ambient conditions within the airflow restricted area 104 may vary significantly in response to traffic through the airflow restricted area 104. For example, as the vehicle system 300 travels through the airflow restricted area 104, the temperature within the airflow restricted area 104 may increase significantly and the available oxygen within the airflow restricted area 104 may decrease significantly relative to a non-traffic state of the airflow restricted area 104. Due to the low ventilation and airflow, the airflow restricted area 104 may still be at an increased temperature level and a reduced oxygen level as the vehicle system 100 enters the airflow restricted area 104. The increased temperature and reduced available oxygen within the area 104 due to the traffic ahead (e.g., the vehicle system 300) causes the performance of the propulsion vehicles 106 of the vehicle system 100 to suffer to a greater extent than if the area 104 has a lower temperature and a greater oxygen content as the vehicle system 100 enters the area 104. For example, the vehicles 106 are more likely to derate within the area 104 if the air is at an elevated temperature when the vehicle system 100 enters the area 104 due to the vehicle system 300 ahead than if the air within the area 104 has a lower temperature and/or more available oxygen.

In an embodiment, the vehicle control system 320 is able to modify the power outputs generated by the individual propulsion vehicles 106 based on the ambient conditions within the area 104. The ambient conditions within the area 104 used to modify the movement of the vehicle system 100 may be measured by the sensors 1126 (shown in FIG. 2) on the vehicle 106, the sensors 302 on the vehicle system 300 ahead, and/or the sensors 308 mounted within the area 104. Therefore, the vehicle control system 320 is able to adjust the power outputs generated by the vehicles 106 based on the conditions within the airflow restricted area 104 in order to better achieve one or more goals, such as reducing the travel time through the area 104, relative to controlling the vehicle system 100 through the airflow restricted area 104 without accounting for the conditions within the area 104. For example, if the vehicle system 100 is controlled to travel through the airflow restricted area 104 based on an assumed temperature within the area 104 as the vehicle system 100 enters, then the performance of the vehicle system 100 may suffer if the actual temperature differs from the assumed temperature. If the actual temperature is hotter than the assumed temperature (e.g., due to a vehicle system ahead that recently traveled through the area 104), then the increased temperature may cause the propulsion vehicles 106 to derate sooner than expected and/or to a greater extent than expected, resulting in reduced overall power output within the area 104, and, therefore, reduced speed. Furthermore, if the actual temperature is below the assumed temperature, then the propulsion vehicles 106 may be able to generate more power than the designated power outputs, such that the vehicle system 100 could have generated a greater overall power output and traveled faster through the area 104 than realized.

Figure 4:
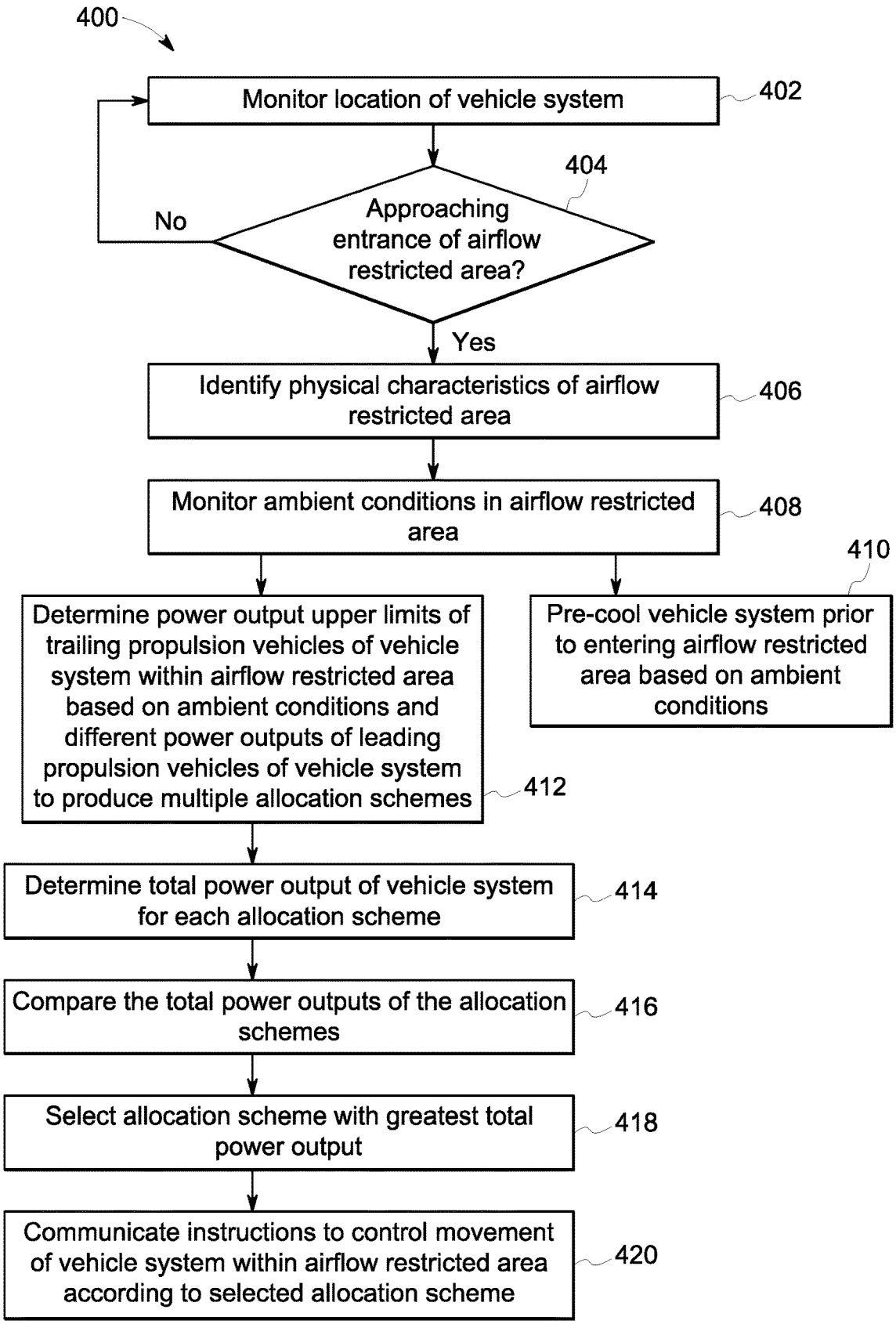
FIG. 4 illustrates a flowchart of one embodiment of a method for controlling a vehicle system along a route.

FIG. 4 illustrates a flowchart of one embodiment of a method 400 for controlling a vehicle system along a route. The method 400 is described in connection with the vehicle system 100 as shown in FIGS. 1 and 3 described herein. At 402, location of the vehicle system is monitored as the vehicle system travels along the route. For example, the location determining device 1124 disposed onboard one of the propulsion vehicles 106 of the vehicle system 100 may provide location data used by one or more processors (e.g., of the controller 1102 of one of the propulsion vehicles 106) to determine the location of the vehicle system 100 along the route 102. The one or more processors may compare the location data received from the location determining device to a map, route data, a trip schedule, a trip plan, or the like to determine the progress of the vehicle system during a trip and/or the proximity of the vehicle system to a location of interest along the route, such as an airflow restricted area. The map, route data, trip schedule, and/or trip plan may be stored in the memory 1106 of the controller 1102 and accessed by the one or more processors 1104.

At 404, a determination is made as to whether the vehicle system is approaching an entrance of an airflow restricted area. For example, the location of an entry into a tunnel or a ravine may be previously identified and stored in a database or other memory component or structure, such as a database on the memory 1106 of the controller 1102. The database may store the locations of multiple airflow restricted areas along the route, including information specific to the airflow restricted areas such as the entrance locations and the exit locations of the areas. The locations of the vehicle system may be compared to the location of the entry on a periodic, continuous, or on-demand basis.

If the location of the vehicle system (e.g., the leading or front vehicle, such as the propulsion vehicle 106A in FIG. 1) is within a designated distance of the entrance of an upcoming airflow restricted area, then the operations of the propulsion vehicles of the vehicle system may be modified and coordinated with each other to permit the vehicle system to travel through the airflow restricted area to better achieve one or more goals relative to continuing the previous operations of the propulsion vehicles into the airflow restricted area without modification. For example, the operations of the propulsion vehicles may, up until the vehicle system is within the designated distance of the airflow restricted area, be manually controlled or be controlled based on a trip plan. When the vehicle system approaches the entrance, however, these operations may need to be altered or coordinated with each other in a manner that differs from the operations designated by the manual control or by the trip plan. For example, if left unchanged, the manual control of the propulsion vehicles may result in one or more of the propulsion derating too much and/or too quickly such that the vehicle system is unable to pass through the airflow restricted area within a designated time period, with at least a designated speed, and/or with at least a designated total power output. As another example, the designated operational settings of the trip plan, if left unchanged, may also result in the propulsion vehicles derating too much and/or too quickly such that the vehicle system is unable to achieve one or more goals when passing through the airflow restricted area. Therefore, once it is determined that the vehicle system is relatively close to the entrance of the airflow restricted area, control of the operations of the propulsion vehicles may be altered to allow the vehicle system to travel through the airflow restricted area with a greater total power output (and, therefore, faster and in less elapsed time) relative to controlling operations of the propulsion vehicles according to manual control or the trip plan.

If it is determined that the vehicle system is approaching the entrance to an airflow restricted area (e.g., the vehicle system is within the designated distance or a designated time from the entrance), then flow of the method 400 may proceed to 406. On the other hand, if the vehicle system is not yet close to the entrance of the airflow restricted area, then flow of the method 400 may return to 402 where the locations of the vehicle system continue to be monitored. If the vehicle system is approaching or has reached a destination location of the trip, then the vehicle system may cease monitoring the location of the vehicle system and performing other steps of the method 400 that are described below.

At 406, physical characteristics of the specific upcoming airflow restricted area are identified. The physical characteristics describe dimensions of the airflow restricted area, such as a length of the area along the route between the entrance and the exit of the area, an altitude of the area, a grade of the area, a cross-sectional area and/or diameter of the area, a volume of the area, or the like. For example, the airflow restricted area may be a tunnel with a relatively constant cross-sectional area along the length of the tunnel, such that the volume of the tunnel can be determined by multiplying the cross-sectional area times the length. The physical characteristics may be associated with segments of the length of the airflow restricted area, such that a first grade may correspond to one segment and a second grade may correspond to another segment. The physical characteristics may be stored in a database of a digital memory, such as the memory 1106 of the controller 1102 of the propulsion vehicle 106 shown in FIG. 2. For example, upon determining that the vehicle system is approaching or will be approaching the airflow restricted area during a trip, one or more processors may access the database to retrieve the physical characteristic information associated with the specific airflow restricted area.

The physical characteristics may be used by the one or more processors when determining how various power outputs generated by a lead propulsion vehicle of the vehicle system will affect the conditions within the airflow restricted area and, therefore, the capable power outputs of a trail propulsion vehicle of the same vehicle system that is rearward of the lead vehicle. As a vehicle system travels through an airflow restricted area, the ambient temperature within the airflow restricted area will increase, due to the heat rejected by the traveling vehicle, at a rate that is based at least in part on the volume of the area. For example, a first airflow restricted area that is longer and/or narrower than a second airflow restricted area may be able to dissipate less heat and/or exhaust gas than the second airflow restricted area. In response to the lead propulsion vehicle generating a given power output, the trail propulsion vehicle may be able to generate a greater power output within the second airflow restricted area than within the first airflow restricted area (due to the increased ventilation).

At 408, ambient conditions in the airflow restricted area are monitored. For example, the ambient conditions in the airflow restricted area may be measured by the ambient condition sensors 1126 on the propulsion vehicle 106 (shown in FIG. 2) of the vehicle system 100 as the propulsion vehicle 106 enters the airflow restricted area. Alternatively or in addition, the ambient conditions in the airflow restricted area may be measured by the ambient condition sensors 302 on the vehicle system 300 (shown in FIG. 3) ahead of the vehicle system 100 and/or the ambient condition sensors 308 (FIG. 3) mounted within the airflow restricted area. The data parameters representative of the ambient conditions, such as temperature, pressure, oxygen content, rate of airflow, and the like, are transmitted to one or more processors periodically or upon request to allow the one or more processors to monitor the ambient conditions within the airflow restricted area. If the ambient condition within the area is monitored based on the sensors 302 from the vehicle system 300 ahead and/or the sensors 308 mounted within the airflow restricted area, the ambient conditions of the area may be monitored prior to the vehicle system entering the airflow restricted area.

At 410, the vehicle system is pre-cooled prior to entering the airflow restricted area based on the ambient conditions within the airflow restricted area. The pre-cooling includes cooling components of the propulsion systems (e.g., the propulsion system 1112 of each vehicle 106 shown in FIG. 2) of the vehicle system, such as the engines, motors, cooling systems, electric circuits, transformers, inverters, and the like. By way of example, the speed of cooling fans or blowers that move air over the components of the propulsion systems and/or associated electric circuits may increase to cool the components. In addition, resistive grids of braking systems of the vehicle system may reject additional current (e.g., heat). As a result, the temperatures of the components of the propulsion systems and fluids associated with the components such as engine oil and cooling system coolants, may decrease relative to temperatures of the same components and fluids if the pre-cooling was not performed. By performing the pre-cooling prior to entering the airflow restricted area, the propulsion systems of the vehicle system can absorb more heat within the airflow restricted area, and therefore are slower to derate.

In an embodiment, a level of pre-cooling performed by the vehicle system prior to entering the airflow restricted area is based on the monitored ambient conditions in the airflow restricted area. For example, based on a first temperature, a first oxygen content, and a first air flow rate within the airflow restricted area, the one or more processors of the vehicle system may determine to perform a first non-zero level of pre-cooling prior to entering the airflow restricted area. The first non-zero level may include operating the cooling fans and/or blowers at a first speed. In response to the monitored ambient conditions indicating a temperature lower than the first temperature, an oxygen content greater than the first oxygen content, and/or an air flow rate greater than the first air flow rate, the one or more processors may either perform a second level of pre-cooling that is lower than the first level or may skip the pre-cooling step. In another example, responsive to the monitored ambient conditions indicating a temperature greater than the first temperature, an oxygen content lower than the first oxygen content, and/or an air flow rate lower than the first air flow rate, the one or more processors may perform a third level of pre-cooling that is greater than the first level such that the fans and/or blowers operate at a higher speed than the first speed. When the outside air temperature is relatively hot and/or a vehicle ahead of the vehicle system recently traveled through the airflow restricted area, the airflow restricted area may have a greater temperature than the first temperature and/or an oxygen content lower than the first oxygen content, such that the third level (or another increased level) of pre-cooling is performed prior to entering the airflow restricted area.

At 412, power output upper limits of trailing propulsion vehicles of the vehicle system within the airflow restricted area are determined based on the ambient conditions of the airflow restricted area, the physical characteristics of the airflow restricted area, and based on different potential power outputs of leading propulsion vehicles of the vehicle system. For example, with reference to FIG. 1, as the vehicle system 100 travels through the airflow restricted area 104, the lead propulsion vehicle 106A generates a power output that is used to propel the vehicle system 100 through the airflow restricted area 104. The combustion of fuel to generate the power output produces energy in the form of heat that is rejected from the vehicle 106A into the airflow restricted area 104, which increases the ambient temperature in the area 104 due to the reduced ventilation therein. The lead vehicle 106A also consumes available oxygen within the area 104 and emits exhaust gases into the area 104. Therefore, the trailing propulsion vehicles 106B and 106C behind the lead vehicle 106A experience a greater temperature and a reduced amount of available oxygen relative to the lead vehicle 106A. As a result, the trailing propulsion vehicles 106B, 106C (especially the trail vehicle 106C) risk derating within the airflow restricted area 104 more quickly than the lead vehicle 106A due to high temperatures and limited oxygen for combustion. As the power output of the lead vehicle 106A increases, so too may the amount of heat rejected from the vehicle 106A and the consumed amount of available oxygen. Therefore, a higher power output of the lead vehicle 106A generally causes the trailing propulsion vehicles 106B, 106C to derate more quickly and produce less power output than if the lead vehicle 106A generates a lower power output within the area 104.

For example, if the lead vehicle 106A generates a power output associated with a tractive setting of 10, then the trail vehicle 106C may only be capable of generating a power output corresponding to a tractive setting of 2 due to derating, even if the trail vehicle 106C is requested to generate a higher power output. But, if the lead vehicle 106A generates a power output of 8, then the trail vehicle 106C may be able to generate a power output of 5 because the lead vehicle 106A emits less heat and/or consumes less oxygen so the conditions are better for the trail vehicle 106C. Although the lead vehicle 106A generates more power in the first scenario than the second scenario, the combined power output of the lead and trail vehicles 106A, 106C is greater in the second scenario than the first scenario (e.g., $8+5=13>10+2=12$). As a result, the vehicle system 100 would be able to generate more power through the airflow restricted area 104, and travel faster through the area 104, by the lead vehicle 106A generating the lower power output of 8 than the higher power output of 10.

The power output upper limit of a trailing propulsion vehicle represents a power output that the propulsion vehicle is able to generate within the airflow restricted area in the specific conditions to be experienced by the propulsion vehicle. The power output upper limit may be the greatest power output at which the trailing propulsion vehicle is not expected to derate at all or beyond a designated threshold (e.g., a decrease in power output of less than 10%, less than 20%, or the like). Alternatively, the power output upper limit may represent an average power output that accounts for derating of the propulsion vehicle. For example, if the trailing propulsion vehicle entering the area at a power output of 4 derates within the airflow restricted area and provides an average power output of 3 within the area, then the power output upper limit of the trailing vehicle based on the conditions would be considered as 3, not 4.

The power output upper limit of the trailing propulsion vehicles can be determined various ways, such as via a look-up table using historical data or via a calculation using thermodynamic equations. Input information that affects the power output upper limit of each trailing propulsion vehicle includes vehicle system information, ambient conditions of the airflow restricted area, physical characteristics of the airflow restricted area, and power outputs of all leading propulsion vehicles ahead of the trailing propulsion vehicle in the same vehicle system. For example, the vehicle system information may include total weight of the vehicle system, weight of cargo carried by the vehicle system, emissions data about the propulsion vehicles, heat-generation data about the propulsion vehicles, data about how much heat the propulsion vehicles can absorb and withstand prior to derating, and the like. A lead propulsion vehicle generating a designated power output produces a given amount of heat and exhaust gas that is rejected into the airflow restricted area. The effect of that heat and exhaust gas on a trailing propulsion vehicle depends on the ambient conditions within the area (just prior to the lead propulsion vehicle entering the area), the physical characteristics of the area including the volume of the area and the length of the area, and the ability of the trail propulsion vehicle to absorb heat and/or operate with reduced available oxygen. It is further recognized that intermediate propulsion vehicles, such as the intermediate propulsion vehicle 106B shown in FIG. 1, are both trailing vehicles and leading vehicles. The power output of the lead propulsion vehicle 106A affects the power output upper limit that can be generated by the intermediate vehicle 106B, but the power outputs generated by both the lead vehicle 106A and the intermediate vehicle 106B affect the power output upper limit that can be generated by the trail vehicle 106C.

Figure 5:
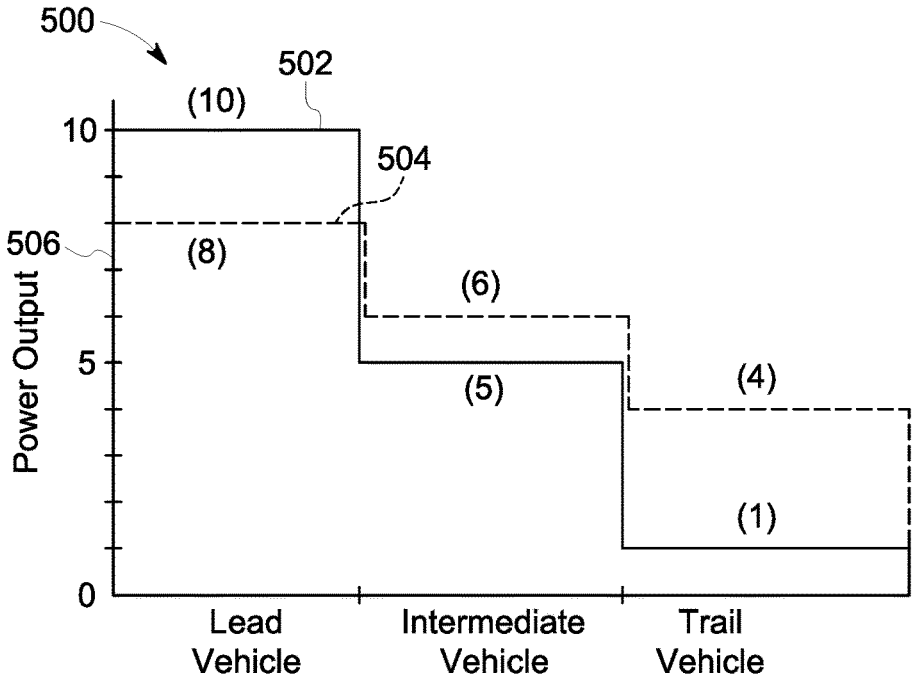
FIG. 5 is a graph showing two allocation schemes for propulsion vehicles of the vehicle system approaching an airflow restricted area according to an embodiment.

FIG. 5 is a graph 500 showing two allocation schemes 502, 504 for three propulsion vehicles of the vehicle system approaching an airflow restricted area of a route according to an embodiment. The graph 500 includes a y-axis 506 representing a power output provided by the propulsion vehicles within the airflow restricted area. The y-axis 506 is labeled 0-10 and is unitless. The power outputs may correspond to tractive settings and increase with the size of the number. For example, the power output 10 is greater than the power output 9. The three propulsion vehicles may represent the vehicles 106 of the vehicle system 100 shown in FIG. 1, including the lead propulsion vehicle 106A, the trail propulsion vehicle 106C, and the intermediate propulsion vehicle 106B disposed between the lead and trail vehicles 106A, 106C. The power outputs of the intermediate and trail vehicles 106B, 106C in the allocation schemes 502, 504 may represent the power output upper limits as determined by one or more processors of a control system, such as the one or more processors 1104 of the controller 1102 shown in FIG. 2.

In the first allocation scheme 502, the lead vehicle generates a power output of 10 within the airflow restricted area. The power output upper limit of the intermediate vehicle is determined based on an amount of heat emitted by the lead vehicle, an amount of oxygen consumed by the lead vehicle, and/or an amount of exhaust emissions emitted by the lead vehicle as the lead vehicle generates the power output of 10. As described above, the power output upper limit of the intermediate vehicle is also determined based on the physical characteristics of the airflow restricted area, the ambient conditions within the airflow restricted area, and the ability of the intermediate vehicle to operate in increased temperature and/or reduced oxygen environments. For example, a level of pre-cool of the intermediate vehicle prior to entering the airflow restricted area affects the quantity of heat that the components of the propulsion system of the vehicle can absorb prior to derating or otherwise experiencing a reduction in performance.

In one embodiment, the power output upper limit of the intermediate vehicle is determined by one or more processors by consulting a look-up table or a model constructed based on historical data of previous trips. The previous trips may be trips of the same vehicle system and/or similar vehicle systems traveling through the same or similar airflow restricted areas. For example, the inputs that are entered into a model or used to navigate a look-up table include the ambient conditions (e.g., temperature and oxygen content), the physical characteristics of the area (e.g., length, cross-sectional area, and/or volume), the vehicle system information (e.g., type and known emissions of the propulsion systems of the propulsion vehicles), and the power output of any leading vehicles (e.g., the power output of 10 of the lead vehicle in this case). Based on the inputs and the look-up table and/or model, the one or more processors estimate the power output upper limit of the intermediate vehicle.

In another embodiment, the power output upper limit of the intermediate vehicle is determined by one or more processors by calculating the power output upper limit using various thermodynamic equations. For example, based on the monitored ambient temperature in the airflow restricted area prior to the vehicle system entering the area, the known physical characteristics of the airflow restricted area, and the known power output of the lead propulsion vehicle, the one or more processors may be able to calculate the heat rejected from the lead vehicle into the airflow restricted area and the resulting temperature increase in the area that is experienced by the intermediate vehicle. Additional computations can be made to estimate the effect of the increased temperature on the propulsion system of the intermediate vehicle, including estimating when the propulsion system may overheat and/or derate. Similar calculations may be made concerning oxygen availability, such that an amount of oxygen available to the intermediate vehicle may be estimated based on the ambient oxygen content in the area and the power output of the lead vehicle. Similar calculations may be performed by the one or more processors to determine the power output upper limit of the trail vehicle that is affected by both the power output of the lead vehicle and the power output of the intermediate vehicle. For example, differential equations may be solved to determine the power output upper limit of the trail vehicle based on both leading vehicles.

In the illustrated graph 500, the power output upper limit of the intermediate vehicle in response to the lead vehicle generating a power output of 10 is a power output of 5. The intermediate vehicle may generate a power output of 5 or less within the airflow restricted area without experiencing derating or a significant reduction in performance. If the intermediate vehicle attempts to operate at a power output above 5, such as at level 7, the intermediate vehicle will derate and experience a significant reduction in performance such that the average power generated by the intermediate vehicle within the area is less than if the intermediate vehicle generated power output 5 throughout the entire length of the airflow restricted area.

The power output upper limit of the trail vehicle is affected by the power outputs of both the lead vehicle and the intermediate vehicle, as the trail vehicle experiences a temperature in the airflow restricted area affected by both the heat rejected by the lead vehicle and the heat rejected by the intermediate vehicle. In addition, the oxygen available for use by the trail vehicle is reduced by the amount of oxygen consumed by the propulsion system of the lead vehicle and the amount of oxygen consumed by the propulsion system of the intermediate vehicle. In the first allocation scheme 502, the power output upper limit of the trail vehicle in response to the lead vehicle generating a power output of 10 and the intermediate vehicle generating a power output of 5 is 1. For example, the temperature in the airflow restricted area may cause one or more components of the propulsion system of the trail vehicle to overheat, resulting in the limited power output capability. The low power output capability of the trail vehicle may also be the result of the lead vehicle and the intermediate vehicle consuming a significant amount of the available oxygen in the airflow restricted area, such that the combustion of the trail vehicle is limited by oxygen.

In the second allocation scheme 504, the lead vehicle generates a power output of 8 within the airflow restricted area, so the lead vehicle emits less heat and/or consumes less oxygen than the lead vehicle in the first allocation scheme 502. As a result, the intermediate vehicle is capable of generating a power output of 6, which is a greater upper limit than the upper limit of 5 in the first allocation scheme 502. The power output upper limit of the trail vehicle in response to the lead vehicle generating a power output of 8 and the intermediate vehicle generating a power output of 6 is 4. Although the power output upper limit of 4 indicates that the trail vehicle does suffer from the increased temperature and/or reduced oxygen in the airflow restricted area due to the power outputs generated by the lead and intermediate vehicles ahead, the trail vehicle according to the second allocation scheme 504 is able to generate significantly more power than the trail vehicle according to the first allocation scheme 502. The graph 500 in FIG. 5 shows that the lead vehicle, the intermediate vehicle, and the trail vehicle generate power outputs of 10, 5, and 1, respectively, in the first allocation scheme 502 and power outputs of 8, 6, and 4, respectively, in the second allocation scheme 504.

Figure 6:
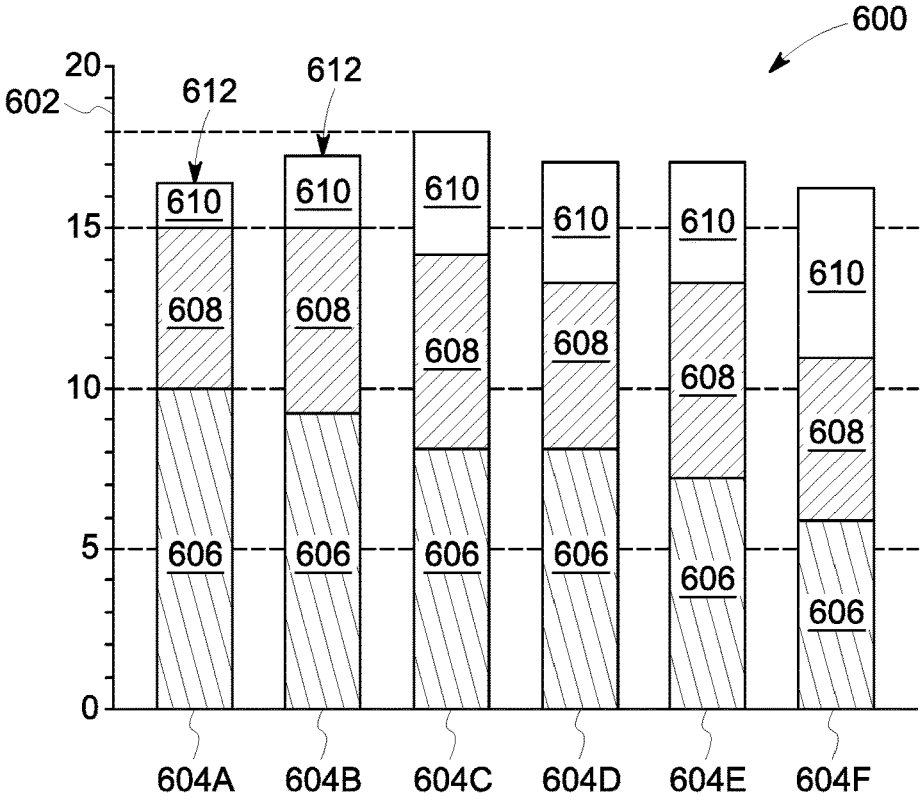
FIG. 6 illustrates a histogram plotting various allocation schemes of the vehicle system in accordance with an example.

FIG. 6 illustrates a histogram 600 plotting various allocation schemes 604 of the vehicle system 100 (shown in FIG. 1) in accordance with an example. The histogram 600 represents power outputs of the propulsion vehicles 106A-C of the vehicle system 100 according to the allocation schemes 604. The vertical axis 602 represents power output, such as horsepower, that is generated by the propulsion vehicles 106A-C. The vertical axis 602 is labeled 0-20 for illustrative purposes, with the numerals representing magnitude of power output (e.g., 10 is a greater power output than 9). The illustrated histogram 600 shows six allocation schemes 604A-F. Each allocation scheme 604 includes individual power outputs 606, 608, 610 of the propulsion vehicles 106A-C as the vehicle system 100 approaches and/or travels through the airflow restricted area 104. For example, the individual power outputs 606 represent the power outputs provided or generated by the lead propulsion vehicle 106A, the individual power outputs 608 represent the power outputs generated by the intermediate propulsion vehicle 106B, and the individual power outputs 610 represent the power outputs generated by the trail propulsion vehicle 106C. The individual power outputs 606 of the lead vehicle 106A in the schemes 604A-F may be selected based on capabilities of the lead vehicle 106A. For example, the lead vehicle 106A the output of 10 may be a power output upper limit of the lead vehicle 106A, regardless of the ventilation of the area through which the vehicle system 100 travels. The individual power outputs 608, 610 of the intermediate and trail vehicles 106B, 106C in the schemes 604A-F may be determined by the one or more processors, as described above, based on the power output 606 of the lead vehicle 106A, the ambient conditions within the airflow restricted area 104, the physical characteristics of the airflow restricted area 104, and the vehicle system information.

In the first allocation scheme 604A, the lead propulsion vehicle 106A generates a power output of 10. As described above with reference to the first allocation scheme in FIG. 5, when the lead propulsion vehicle 106A generates the power output of 10, one or more processors may determine that the intermediate vehicle 106B can generate a power output upper limit of 5 and the trail vehicle 106C can generate a power output upper limit of 1 through the airflow restricted area 104. In the second allocation scheme 604B, the lead propulsion vehicle 106A generates a power output of 9. In response to the reduced output of the lead vehicle 106A, it is determined that the intermediate vehicle 106B can generate a power output upper limit of 6 and the trail vehicle 106C can generate a power output upper limit of 2 through the airflow restricted area 104. In the third allocation scheme 604C, the lead propulsion vehicle 106A generates a power output of 8, the intermediate vehicle 106B can generate a power output upper limit of 6 and the trail vehicle 106C can generate a power output upper limit of 4. In the fourth allocation scheme 604D, the power output of the lead vehicle 106A is the same as the third scheme 604C at 8, but the power output of the intermediate vehicle 106B is at 5, which is below the determined upper limit of 6. In response to the reduction in power output of the intermediate vehicle 106B, the trail vehicle 106C may be able to generate at least slightly more power than the third allocation scheme 604C, but, as shown, the output is the same at 4. In the fifth allocation scheme 604E, the lead propulsion vehicle 106A generates a power output of 7, the intermediate vehicle 106B can generate a power output upper limit of 6 and the trail vehicle 106C can generate a power output upper limit of 4. In the sixth allocation scheme 604F, the lead propulsion vehicle 106A generates a power output of 6, the intermediate vehicle 106B can generate a power output upper limit of 5 and the trail vehicle 106C can generate a power output upper limit of 5.

With additional reference to the method 400 in FIG. 4, at 414, a total power output of the vehicle system 100 entering the airflow restricted area 104 is determined for each of the multiple allocation schemes 604. The total power output is the sum of the individual power outputs 606, 608, 610 of the propulsion vehicles 106A-C of the vehicle system 100 for each allocation scheme 604A-F. The total power outputs may be referred to as total available power outputs of the vehicle system because, for example, the determined output 610 of the trail vehicle 106C in each allocation scheme 604 represents an upper limit of the power output that the trail vehicle 106C can generate based on the conditions of the airflow restricted area 104 experienced by the trail vehicle 106C (e.g., behind the leading vehicles 106C, 106B). Therefore, the trail vehicle 106C is able to generate less than the power outputs 610 shown in the histogram 600, but is not able to generate more than the power outputs 610.

As shown in FIG. 6, the first allocation scheme 604A has a total power output 612 of 16, which is the sum of the power output 606 of 10, the power output 608 of 5, and the power output 610 of 1. The second allocation scheme 604B has a total power output 612 of 17 (e.g., 9+6+2). The third allocation scheme 604C has a total power output 612 of 18 (e.g., 8+6+4). The fourth allocation scheme 604D has a total power output 612 of 17 (e.g., 8+5+4). The fifth allocation scheme 604E has a total power output 612 of 17 (e.g., 7+6+4). The sixth allocation scheme 604F has a total power output 612 of 16 (e.g., 6+5+5).

In the method 400 at 416, the total power outputs 612 of the allocations schemes 604 are compared. The comparison shows that the third allocation scheme 604C has the greatest total power output at 18 relative to the other allocation schemes 604A, 604B, 604D, 604E, 604F. Therefore, movement of the vehicle system 100 through the airflow restricted area 104 according to the allocation of power outputs 606, 608, 610 defined in the third allocation scheme 604C may allow the vehicle system 100 to travel through the airflow restricted area 104 with the greatest amount of power, with the fastest speeds, and/or in the least amount of time, relative to controlling movement of the vehicle system 100 through the area 104 according to any of the other allocation schemes 604A, 604B, 604D, 604E, 604F.

The one or more processors 1104 are not only able to determine that operating the lead propulsion vehicle 106A at a reduced power output entering the airflow restricted area 104 would allow the vehicle system 100 to generate an overall greater amount of power output relative to the lead vehicle 106A generating an upper limit power output (e.g., output 10). The one or more processors 1104 also determine (e.g., estimate or predict) the power output that the lead vehicle 106A and all other propulsion vehicles 106 of the vehicle system 100 should generate within the airflow restricted area. For example, the sixth allocation scheme 604F designates that the lead propulsion vehicle 106A generate a power output of 6, which is less than the power output of 10 in the first scheme 604A, but the total power output 612 of the sixth scheme 604F is the same as the total power output 612 of the first scheme 604F. Therefore, simply reducing the power output of the lead vehicle 106A relative to a max or upper limit power output of the lead vehicle 106A does not provide the benefit of better achieving a goal such as generating a greater total amount of power through an airflow restricted area 104. The one or more processors 1104 are able to determine how much the power output of the lead vehicle 106A should be reduced relative to the max or upper limit power output of the lead vehicle 106A, as well as how much power the trailing propulsion vehicles 106B, 106C should generate.

At 418, the allocation scheme 604 with the greatest total power output 612 is selected. In the illustrated embodiment, the third allocation scheme 604C is selected because the third scheme 604C has the greatest total power output.

At 420, instructions are communicated to control the movement of the vehicle system 100 within the airflow restricted area 104 according to the selected allocation scheme 604C. In an embodiment, the instructions are communicated by the one or more processors 1104 (shown in FIG. 2) via communicating control signals to the propulsion systems 1112 (FIG. 2) of the propulsion vehicles 106 for automatic implementation of the control signals by the propulsion systems 1112. The controls signals are communicated through a wired connection (e.g., along the cable 1118 between vehicles) and/or a wireless connection (e.g., via the communication device 1114). The control signals may identify a tractive setting for the recipient propulsion vehicle 106 to implement in order to generate a designated amount of power output. The one or more processors 1104 may transmit control signals specific to each propulsion vehicle 106 according to the allocation scheme 604C. For example, the control signals communicated to the lead vehicle 106A may designate a specific tractive setting or other operational setting that would cause the propulsion system 1112 of the vehicle 106A to generate a power output corresponding to the value 8 in the histogram 600 in FIG. 6. Upon receiving the control signals, the propulsion vehicles 106 may automatically implement the control signals, such that the operations of the propulsion vehicles 106 are autonomously controlled. In an alternative embodiment, in response to receiving the control signals, one or more propulsion vehicles 106 may present one or more messages, alarms, or other notifications to an operator of the vehicle system 100 via the input/output device 1120 (FIG. 2) to direct the operator on how to control the operations of the propulsion vehicles 106.

Optionally, the selected allocation scheme 604C may be added to a trip plan that is generated or revised by the energy management system 1108 shown in FIG. 2 or another trip-planning device. For example, the trip plan may be generated or revised such that, as the vehicle system 100 approaches an airflow restricted area, the operational settings dictated by the trip plan that control the propulsion vehicles to travel according to the power outputs 606, 608, 610 in the selected allocation scheme 604C. In areas of the route before and after the airflow restricted area, the trip plan may designate operational settings that control the propulsion vehicles differently than the allocation scheme 604C.

Figure 7:
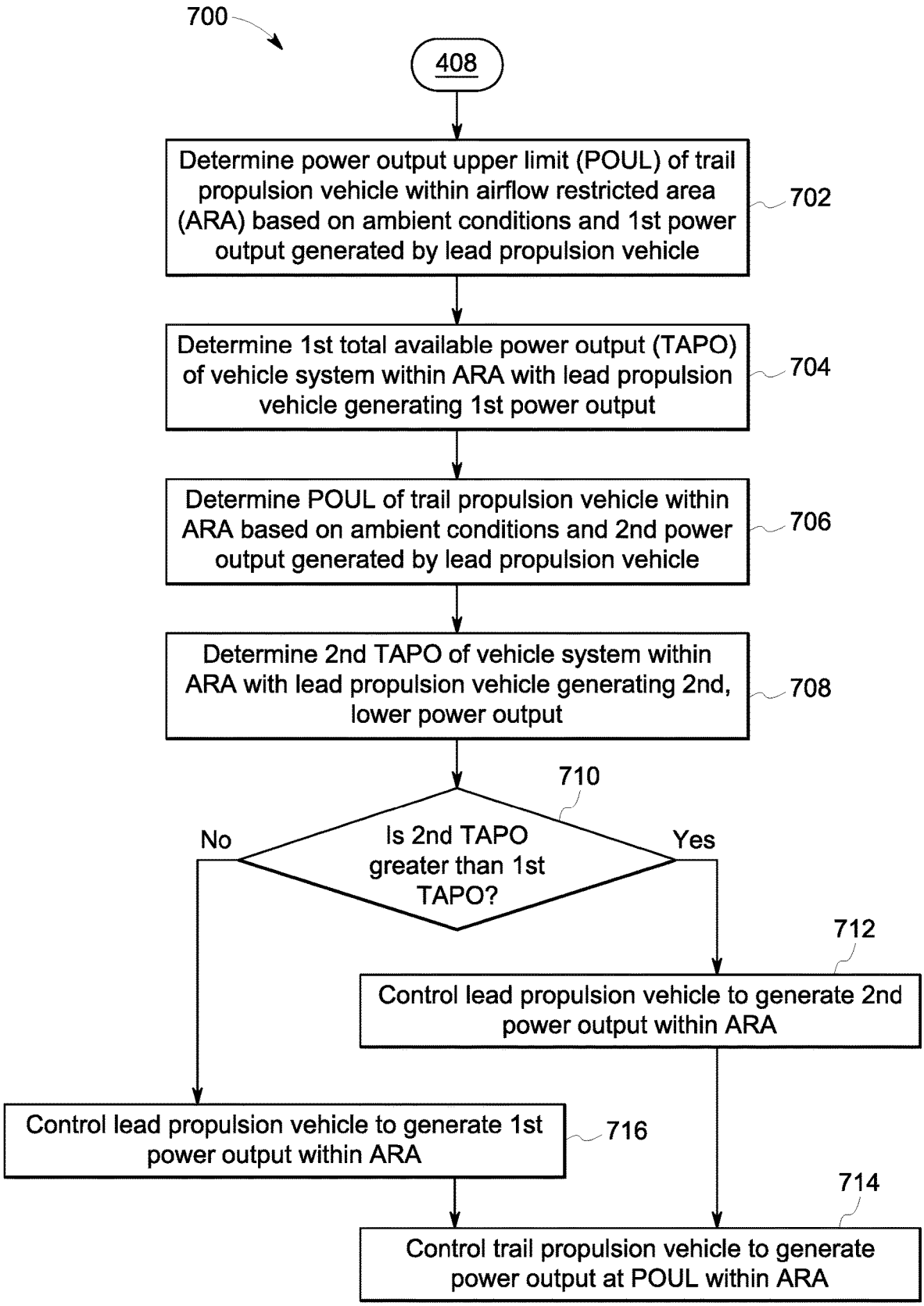
FIG. 7 illustrates a flowchart of one embodiment of a method for controlling a vehicle system along a route through an airflow restricted area.

FIG. 7 illustrates a flowchart of one embodiment of a method 700 for controlling a vehicle system along a route through an airflow restricted area. The method 700 describes a specific implementation of the method 400 shown in FIG. 4 for controlling a vehicle system having two propulsion vehicles through the airflow restricted area with the goal of increasing the speed through the airflow restricted area to reduce the total time within the area. For example, the vehicle system includes a lead propulsion vehicle and a trail propulsion vehicle, referred to herein as lead vehicle and trail vehicle, respectively. The trail vehicle is rearward of the lead vehicle along a direction of travel of the vehicle system. The vehicle system approaches an airflow restricted area along the route, such as a tunnel, a ravine, or the like, such that the lead vehicle enters the airflow restricted area prior to the trail vehicle. The method 700 may be performed by the one or more processors 1102 (shown in FIG. 2) disposed onboard one of the propulsion vehicles 106 of the vehicle system 100 or one or more processors disposed off-board the vehicle system 100, such as at a dispatch location, a wayside device, or the like.

The method 700 starts after the step 408 in the method 400 shown in FIG. 4. For example, after it is determined that the vehicle system is approaching the entrance to an airflow restricted area along the route (e.g., 404), the physical characteristics of the airflow restricted area are identified (e.g., 406), and the ambient conditions in the airflow restricted area are monitored (e.g., 408), then flow proceeds to 702 in FIG. 7. At 702, a power output upper limit (POUL)

of the trail vehicle within the airflow restricted area is determined based on the ambient conditions within the area and a first power output generated by the lead vehicle. The first power output may be selected based on a capability of the lead vehicle, such as a max power output that the lead vehicle is capable of generating. Alternatively, the first power output may be selected (e.g., randomly) as a power output below the max power output of the lead vehicle. The POUL is determined as the upper limit power output that the trail vehicle would be able to generate within the airflow restricted area based on the conditions expected to be experienced by the trail vehicle within the area, without the trail vehicle suffering significant derating.

At 704, a first total available power output (TAPO) of the vehicle system within the airflow restricted area is determined based on the lead vehicle generating the first power output. Since there are only two propulsion vehicles providing tractive effort, the first TAPO is the sum of the first power output of the lead vehicle and the POUL of the trail vehicle. For example, if the first power output has a unitless magnitude of 10 and the POUL of the trail vehicle in response to the lead vehicle generating the power output of 10 is 3, then the first TAPO is 13 (10+3=13).

At 706, the POUL of the trail vehicle within the airflow restricted area is determined based on the ambient conditions within the area and a second power output generated by the lead vehicle. The second power output is less than the first power output. For example, if the first power output is 10, then the second power output may be 9, 8, 7, 6, or the like. The lead vehicle may generate less heat and exhaust gas and consume less oxygen in response to generating the lower, second power output than the first power output. As a result of the lower temperature, reduced exhaust gas, and/or greater amount of oxygen available, the POUL of the trail vehicle may be greater than when the lead vehicle generates the first power output. In an alternative embodiment, the second power output may be greater than the first power output.

At 708, a second TAPO of the vehicle system within the airflow restricted area is determined based on the lead vehicle generating the second power output. For example, if the second power output has a unitless magnitude of 8 and the POUL of the trail vehicle in response to the lead vehicle generating the power output of 8 is 6, then the second TAPO is 14 (8+6=14).

At 710, a determination is made whether the second TAPO is greater than the first TAPO. In the example provided, the first TAPO is 13 and the second TAPO is 14, so the second TAPO is indeed greater than the first TAPO. Thus, the vehicle system would be able to generate more power within the airflow restricted area by controlling the lead vehicle to generate a power output corresponding to 8 and the trail vehicle to generate a power output corresponding to 6 than if the lead vehicle is controlled to generate a power output of 10, regardless of the power output provided by the trail vehicle. If the second TAPO is greater than the first TAPO, flow of the method 700 continues to 712 and the lead vehicle is controlled to generate the second power output (e.g., output 8) within the airflow restricted area. The lead vehicle may be controlled by one or more processors communicating control signals directly to a propulsion system of the lead vehicle for automatic implementation of the control signals, or by transmitting the control signals to an input/output device that is configured to notify, alert, and/or instruct an operator of the vehicle system to modify operational settings of the lead vehicle. At 714, the trail vehicle is controlled to generate a power output at the POUL within the airflow restricted area. Thus, the trail vehicle is controlled to generate a power output corresponding to 6 in the example provided. By controlling the lead vehicle to generate the second power output within the airflow restricted area, the vehicle system can travel at a greater total actual power output (e.g., faster and in less time) through the airflow restricted area relative to the lead vehicle generating the first power output.

If, on the other hand, the second TAPO is not greater than the first TAPO (e.g., the sum of the first power output of the lead vehicle and the POUL of the trail vehicle based on the first power output is greater than the sum of the second power output of the lead vehicle and the POUL of the trail vehicle based on the second power output), flow of the method 700 continues to 716 and the lead vehicle is controlled to generate the first power output within the airflow restricted area. Flow of the method 700 proceeds to 714 and the trail propulsion vehicle is controlled to generate a power output at the POUL that is based on the lead vehicle generating the first power output.

In one embodiment, a control system includes a communication device and one or more processors operatively connected to the communication device. The communication device is onboard a vehicle system traveling along a route. The vehicle system includes a lead propulsion vehicle and a trail propulsion vehicle with the lead propulsion vehicle located ahead of the trail propulsion vehicle along a direction of travel of the vehicle system. The communication device is configured to receive status messages that contain data parameters representative of ambient conditions within an airflow restricted area along the route that the vehicle system is at least one of approaching or entering. The one or more processors are configured to monitor the ambient conditions within the airflow restricted area based on the status messages that are received. The one or more processors are further configured to determine a power output upper limit that the trail propulsion vehicle can generate within the airflow restricted area based on the ambient conditions and a first power output generated by the lead propulsion vehicle and to determine the power output upper limit of the trail propulsion vehicle within the airflow restricted area based on the ambient conditions and a second power output generated by the lead propulsion vehicle. The second power output is smaller than the first power output. Responsive to a total available power output of the vehicle system within the airflow restricted area with the lead propulsion vehicle generating the second power output exceeding the total available power output of the vehicle system with the lead propulsion vehicle generating the first power output, the one or more processors are configured to communicate instructions to control the lead propulsion vehicle to generate the second power output within the airflow restricted area.

Optionally, the data parameters are representative of at least one of temperature, pressure, available oxygen, or air flow rate within the airflow restricted area.

Optionally, the one or more processors communicate instructions to control the lead propulsion vehicle to generate the second power output within the airflow restricted area by communicating control signals to a propulsion system of the lead propulsion vehicle for automatic implementation of the control signals by the propulsion system.

Optionally, the one or more processors are configured to determine the first and second power output upper limits of the trail propulsion vehicle within the airflow restricted area by determining at least one of an estimated amount of heat emitted or an estimated amount of oxygen consumed by the lead propulsion vehicle within the airflow restricted area responsive to the lead propulsion vehicle generating one of the first power output or the second power output as the lead propulsion vehicle travels through the airflow restricted area.

Optionally, the one or more processors are configured to determine the first and second power output upper limits of the trail propulsion vehicle within the airflow restricted area based also on predetermined physical characteristics of the airflow restricted area including at least one of length, altitude, grade, cross-sectional area, diameter, or volume of the airflow restricted area.

Optionally, the one or more processors are further configured to pre-cool a coolant of a cooling system of the vehicle system prior to the vehicle system entering the airflow restricted area. The one or more processors pre-cool the coolant at a level based on the ambient conditions of the airflow restricted area.

Optionally, the communication device is configured to receive the status messages that contain the data parameters representative of the ambient conditions within the airflow restricted area prior to the vehicle system entering the airflow restricted area. The status messages are received from at least one of a sensing device disposed within the airflow restricted area, a dispatch location, or another vehicle system that recently traveled through the airflow restricted area.

In another embodiment, a method includes monitoring ambient conditions within an airflow restricted area along a route traveled by a vehicle system as the vehicle system at least one of approaches or enters the airflow restricted area. The vehicle system includes a lead propulsion vehicle and a trail propulsion vehicle with the lead propulsion vehicle located ahead of the trail propulsion vehicle along a direction of travel of the vehicle system. The method also includes determining a power output upper limit that the trail propulsion vehicle can generate within the airflow restricted area based on the ambient conditions and a first power output generated by the lead propulsion vehicle. The method further includes determining the power output upper limit of the trail propulsion vehicle within the airflow restricted area based on the ambient conditions and a second power output generated by the lead propulsion vehicle. The second power output is smaller than the first power output. In response to a total available power output of the vehicle system within the airflow restricted area with the lead propulsion vehicle generating the second power output exceeding the total available power output of the vehicle system with the lead propulsion vehicle generating the first power output, the method includes communicating instructions to control the lead propulsion vehicle to generate the second power output within the airflow restricted area.

Optionally, communicating the instructions to control the lead propulsion vehicle to generate the second power output within the airflow restricted area directs the vehicle system to travel within the airflow restricted area at a greater total actual power output relative to the lead propulsion vehicle generating the first power output.

Optionally, the lead propulsion vehicle generating the second power output emits at least one of less heat or less exhaust gas into the airflow restricted area relative to the lead propulsion vehicle generating the first power output.

Optionally, the total available power output of the vehicle system is a sum of one of the first power output or the second power output generated by the lead propulsion vehicle and the power output upper limit of the trail propulsion vehicle based on the lead propulsion vehicle generating the one of the first power output or the second power output.

Optionally, communicating the instructions to control the lead propulsion vehicle to generate the second power output within the airflow restricted area comprises communicating control signals to a propulsion system of the lead propulsion vehicle for automatic implementation of the control signals by the propulsion system.

Optionally, the airflow restricted area includes at least one of a tunnel or a ravine through which the route passes.

Optionally, the vehicle system further includes an intermediate propulsion vehicle disposed between the lead propulsion vehicle and the trail propulsion vehicle along a length of the vehicle system. The method further includes determining a power output upper limit of the intermediate propulsion vehicle based on the ambient conditions and the lead propulsion vehicle generating one of the first power output or the second power output. The power output upper limit of the trail vehicle is also based on the power output upper limit of the intermediate propulsion vehicle.

Optionally, the ambient conditions that are monitored within the airflow restricted area include at least one of temperature, pressure, available oxygen, or air flow rate within the airflow restricted area.

Optionally, the ambient conditions within the airflow restricted area are monitored by receiving status messages that contain data parameters representative of the ambient conditions. The data parameters measured by one or more sensors disposed at least one of in the airflow restricted area, on the vehicle system, or on another vehicle system that recently traveled through the airflow restricted area.

Optionally, determining the power output upper limit of the trail propulsion vehicle within the airflow restricted area includes determining at least one of an estimated amount of heat emitted or an estimated amount of oxygen consumed by the lead propulsion vehicle within the airflow restricted area responsive to the lead propulsion vehicle generating one of the first power output or the second power output as the lead propulsion vehicle travels through the airflow restricted area.

Optionally, the method further includes pre-cooling a coolant of a cooling system of the vehicle system prior to the vehicle system entering the airflow restricted area. A level of pre-cooling is based on the ambient conditions of the airflow restricted area.

In another embodiment, a control system includes one or more sensors disposed on a vehicle system traveling on a route that includes an airflow restricted area. The vehicle system includes a trail propulsion vehicle and a lead propulsion vehicle that is located ahead of the trail propulsion vehicle along a direction of travel of the vehicle system. The one or more sensors are configured to monitor ambient conditions within the airflow restricted area as the vehicle system enters the airflow restricted area. The one or more processors communicatively connected to the one or more sensors and configured to receive data parameters representative of the ambient conditions within the airflow restricted area from the one or more sensors. The one or more processors are configured to determine a power output upper limit that the trail propulsion vehicle can generate within the airflow restricted area based on the ambient conditions and a first power output generated by the lead propulsion vehicle and to determine the power output upper limit of the trail propulsion vehicle based on the ambient conditions and a second power output generated by the lead propulsion vehicle. The second power output is smaller than the first power output. The one or more processors are configured to communicate instructions to control the lead propulsion vehicle to generate the second power output within the airflow restricted area responsive to determining that a total available power output of the vehicle system within the airflow restricted area with the lead propulsion vehicle generating the second power output exceeds the total available power output of the vehicle system with the lead propulsion vehicle generating the first power output.

Optionally, the one or more sensors monitor at least one of temperature, pressure, available oxygen, or air flow rate within the airflow restricted area as the ambient conditions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A control system comprising:

one or more processors configured to be connected to a communication device onboard a vehicle system that is configured to travel along a route, the one or more processors configured to monitor ambient conditions within an airflow restricted area along the route based on status messages received by the communication device, the one or more processors further configured to:

determine a first power output and a smaller, second power output that the lead propulsion vehicle can generate within the airflow restricted area, determine a first upper limit on power that the trail propulsion vehicle can generate within the airflow restricted area based on the ambient conditions and the first power output generated by the lead propulsion vehicle;

determine a different, second upper limit on the power that the trail propulsion vehicle can generate within the airflow restricted area based on the ambient conditions and the second power output generated by the lead propulsion vehicle;

determine a first total power output of the vehicle system based on the first upper limit of the trail propulsion vehicle;

determine a second total power output of the vehicle system based on the second upper limit of the trail propulsion vehicle; and direct the lead propulsion vehicle to generate the first power output or the second power output during travel within the airflow restricted area based on the first total power output and the second total power output.

2. The control system of claim 1, wherein the ambient conditions include at least one of temperature, pressure, available oxygen, or air flow rate within the airflow restricted area.

3. The control system of claim 1, wherein the one or more processors are configured to communicate one or more instructions to control the lead propulsion vehicle to generate the first power output or the second power output within the airflow restricted area by communicating a control signal to a propulsion system of the lead propulsion vehicle for automatic implementation of the control signal by the propulsion system.

4. The control system of claim 1, wherein the one or more processors are configured to determine the first upper limit and the second upper limit of the trail propulsion vehicle within the airflow restricted area by determining at least one of an estimated amount of heat emitted by the lead propulsion vehicle or an estimated amount of oxygen consumed by the lead propulsion vehicle within the airflow restricted area.

5. The control system of claim 1, wherein the one or more processors are configured to determine the first upper limit and the second upper limit of the trail propulsion vehicle within the airflow restricted area based on at least one of length, altitude, grade, cross-sectional area, diameter, or volume of the airflow restricted area.

6. The control system of claim 1, wherein the one or more processors are further configured to pre-cool a coolant of a cooling system of the vehicle system prior to the vehicle system entering the airflow restricted area.

7. The control system of claim 1, wherein the one or more processors are configured to receive one or more signals indicative of the ambient conditions from at least one of a sensing device disposed within the airflow restricted area, a dispatch location, or another vehicle system that recently traveled through the airflow restricted area.

8. A method comprising:

monitoring ambient conditions within an airflow restricted area along a route traveled by a vehicle system as the vehicle system at least one of approaches or enters the airflow restricted area, the vehicle system including a lead propulsion vehicle and a trail propulsion vehicle;

determining a first upper limit on power that the trail propulsion vehicle can generate within the airflow restricted area based on the ambient conditions and a first power output generated by the lead propulsion vehicle;

determining a different, second upper limit on power that the trail propulsion vehicle can generate within the airflow restricted area based on the ambient conditions and a second power output generated by the lead propulsion vehicle, the second power output generated by the lead propulsion vehicle being less than the first power output;

determining a first total power output of the vehicle system based on the first power output of the lead propulsion vehicle and the first upper limit of the trail propulsion vehicle;

determining a different, second total power output of the vehicle system based on the second power output of the lead propulsion vehicle and the second upper limit of the trail propulsion vehicle;

directing the lead propulsion vehicle to generate the first power output or the second power output during travel within the airflow restricted area based on the first total power output and the second total power output.

9. The method of claim 8, further comprising:

determining that directing the lead propulsion vehicle to generate the second power output results in the lead propulsion vehicle emitting at least one of less heat or less exhaust gas into the airflow restricted area relative to directing the lead propulsion vehicle to generate the first power output.

10. The method of claim 8, wherein determining the first total power output of the vehicle system includes summing the first power output of the lead propulsion vehicle and the first upper limit of the trail propulsion vehicle, and wherein determining the second total power output of the vehicle system includes summing the second power output of the lead propulsion vehicle and the second upper limit of the trail propulsion vehicle.

11. The method of claim 8, wherein directing the lead propulsion vehicle comprises communicating a control signal to a propulsion system of the lead propulsion vehicle for automatic implementation of the control signal by the propulsion system.

12. The method of claim 8, wherein the airflow restricted area includes at least one of a tunnel or a ravine through which the route passes.

13. The method of claim 8, wherein the vehicle system further includes an intermediate propulsion vehicle disposed between the lead propulsion vehicle and the trail propulsion vehicle along a length of the vehicle system, the method further comprising:

determining a third upper limit on a power output of the intermediate propulsion vehicle based on the ambient conditions and the lead propulsion vehicle generating one of the first power output or the second power output, wherein the first upper limit and the second upper limit of the trail vehicle also is based on the third upper limit of the intermediate propulsion vehicle.

14. The method of claim 8, wherein the ambient conditions include at least one of temperature, pressure, available oxygen, or air flow rate within the airflow restricted area.

15. The method of claim 8, wherein the ambient conditions are monitored by receiving one or more status messages sent from one or more sensors disposed at least one of in the airflow restricted area, the vehicle system, or another vehicle system that recently traveled through the airflow restricted area.

16. The method of claim 8, wherein determining the first upper limit and the second upper limit of the trail propulsion vehicle includes determining at least one of an estimated amount of heat emitted by the lead propulsion vehicle or an estimated amount of oxygen consumed by the lead propulsion vehicle within the airflow restricted area.

17. The method of claim 8, further comprising pre-cooling a coolant of a cooling system of the vehicle system prior to the vehicle system entering the airflow restricted area.

18. A control system comprising:

one or more processors configured to be communicatively connected to one or more sensors and to receive data parameters representative of ambient conditions within an airflow restricted area from the one or more sensors, the one or more processors configured to determine a first upper limit on power that a trail propulsion vehicle of a vehicle system can generate within the airflow restricted area based on the ambient conditions and a first power output generated by a lead propulsion vehicle of the vehicle system, the one or more processors also configured to determine a second upper limit on the power that the trail propulsion vehicle can generate within the airflow restricted area based on the ambient conditions and a second power output generated by the lead propulsion vehicle, the second power output of the lead propulsion vehicle being smaller than the first power output of the lead propulsion vehicle, wherein the one or more processors are configured to direct the lead propulsion vehicle to generate the second power output within the airflow restricted area responsive to determining that a first total available power output of the vehicle system within the airflow restricted area with the lead propulsion vehicle generating the second power output exceeds a second total available power output of the vehicle system with the lead propulsion vehicle generating the first power output.

19. The control system of claim 18, wherein the one or more processors are configured to receive the data parameters from the one or more sensors as indicative of at least one of temperature, pressure, available oxygen, or air flow rate within the airflow restricted area.

20. The control system of claim 18, wherein the one or more processors are configured to direct the lead propulsion vehicle to autonomously generate the second power output.

* * * * *